United States Patent [19]

Chan

[11] Patent Number: 4,930,794

[45] Date of Patent: Jun. 5, 1990

[54] TOY SKATEBOARD WITH STEERABLE TRUCK ASSEMBLIES

[76] Inventor: David M. Chan, 401 E. Mission Dr., San Gabriel, Calif. 91776

[21] Appl. No.: 237,709

[22] Filed: Aug. 29, 1988

[51] Int. Cl.[5] ..... A63L 17/02

[52] U.S. Cl. ..... 280/11.28; 280/87.042

[58] Field of Search ..... 280/87.04 A, 11.27, 280/11.28, 87.04 R, 11.19

[56] References Cited

U.S. PATENT DOCUMENTS

| | | | |
|---|---|---|---|
| 244,372 | 7/1881 | Bliss | 280/11.28 |
| 317,501 | 5/1885 | Barton et al. | 280/11.28 |
| 3,992,025 | 11/1976 | Amelio | 280/87.04 A |
| 3,995,873 | 12/1976 | Pantzar | 280/87.04 A |
| 4,060,253 | 11/1977 | Oldendorf | 280/11.28 |
| 4,089,536 | 5/1978 | Larracea | 280/87.04 A |
| 4,127,782 | 11/1978 | Gorlach et al. | 280/87.04 A |
| 4,152,001 | 5/1979 | Christianson | 280/87.04 A |
| 4,180,278 | 12/1979 | Gottlieb | 280/87.04 A |
| 4,185,847 | 1/1980 | Johnson | 280/87.04 A |
| 4,194,752 | 3/1980 | Tilch et al. | 280/87.04 A |

*Primary Examiner*—Charles A. Marmor
*Assistant Examiner*—Richard Camby
*Attorney, Agent, or Firm*—Timothy T. Tyson

[57] ABSTRACT

A toy skateboard is provided with steerable truck assemblies having a minimum of parts. Two longitudinally spaced pivots on the underside of the platform hold the trucks on the platform. A leaf spring with three prongs is placed between each truck and the platform. One or more of the prongs are bent away from the plane of the body of the spring with the two outer prongs always located in the same direction. The diameter of the pivots is less than the diameter of the holes through the trucks allowing the trucks to be tilted in any direction about the pivots. Limit walls molded on the undersurface of the platform limit the rotation of the trucks about the pivots. When the platform is tilted, the springs push the trucks out of the straight forward position into the direction of the tilt thereby mimicking the action of a full sized skateboard.

5 Claims, 2 Drawing Sheets

9 9

TOY SKATEBOARD WITH STEERABLE TRUCK ASSEMBLIES

TECHNICAL FIELD

The present invention pertains to the toy wheeled vehicle art, and more particularly, to a toy skateboard with steerable truck assemblies allowing the skateboard to be steered by tilting the skateboard platform.

BACKGROUND ART

Toy skateboards are fabricated with rigid truck assemblies molded unitarily with the platform. Steering in the manner of real skateboards, i.e. by tilting the platform to direct the wheels, is therefore impossible.

Adaptation of full sized skateboard truck assemblies for use on toys is both impractical and expensive. A typical skateboard truck assembly is shown and described in U.S. Pat. No. 3,992,025. Positioned on the bottom of the skateboard for each truck are a pivot projecting down at a 45° angle with respect to the bottom and a rigid connector projecting down at a 90° angle. The truck is mounted on these fixtures. A cylinder on the truck fits onto the pivot and a lug loosely fits over the connector. Rubber washers on either side of the lug flexibly retain the lug, and thereby the truck, on the connector. The truck is able to rotate about the pivot within the limitations imposed by the rubber washers. As described in U.S. Pat. No. 4,060,253, the skateboard is turned by placing the user's feet on the skateboard platform and tilting the platform to force the trucks to turn on the pivots. The standard 45° angle of the pivot provides a medium turning ability at lower speeds without compromising stability. When pressure is not used to tilt the platform, the rubber washers automatically return the trucks to the straight forward position. Other truck turning assemblies for skates and skateboards are shown in U.S. Pat. Nos. 244,372; 317,501; 3,995,873; 4,089,536; 4,127,282; 4,152,001; 4,180,278; 4,185,847; and 4,194,752. All pivot about a specific turning angle with respect to the platform except for U.S. Pat. Nos. 4,152,001 and 4,194,752. In U.S. Pat. No. 4,152,001, the truck is mounted on a leaf spring and pivots about a fixed angle with reference to the leaf spring instead of the platform. In U.S. Pat. No. 4,194,752, a ball joint is substituted for the pivot shown in U.S. Pat. No. 3,992,025. All have numerous parts unsuitable for a toy.

The present invention is directed to a toy skateboard having steerable truck assemblies based on leaf springs. The leaf springs bend to allow the trucks to turn when the platform is tilted and return the trucks to the straight forward position when the platform is not tilted. The leaf springs in U.S. Pat. No. 4,152,001 are not for this purpose being used instead to absorb bumps to obtain a smoother ride in the manner of springs on a car. However, leaf springs are used in U.S. Pat. Nos. 244,372; 317,501; and 3,995,873 for turning control purposes. But they all require the pivoting of the trucks about fixed angles with respect to the platform in the manner of U.S. Pat. No. 3,992,025. In addition, these leaf spring devices also require numerous parts unsuitable for a toy.

DISCLOSURE OF INVENTION

The present invention is directed to a toy skateboard with steerable truck assemblies having a minimum of parts. The truck assemblies allow the toy skateboard to be steered by tilting the skateboard platform in the desired direction thereby simulating the action of full sized skateboards. Two longitudinally spaced mounting means on the underside of the platform hold the truck assemblies on the platform. Each mounting means has a pivot projecting from the undersurface and passing through a mounting aperture in its truck assembly. Means are provided for retaining each truck axially on its pivot as well as for tilting the truck assembly about its pivot. A biasing means pushes each truck away from the undersurface. The tilting means allows the truck to turn about its pivot by compressing one side of its biasing means when the platform is tilted.

In accordance with one important aspect of the invention, the means for tilting each of the truck assemblies includes providing the mounting aperture in the truck assembly with a width greater than the width of the pivot. The truck can then be tilted in any direction about the pivot limited only when the top of the mounting aperture abuts one side of the pivot and the bottom of the mounting aperture abuts the other side of the pivot.

In accordance with another important aspect of the invention, the means for biasing each of the truck assemblies away from the undersurface of the platform is a leaf spring positioned between the truck assembly and the undersurface. The leaf spring has a body portion and three prongs projecting from the body portion substantially parallel to each other with one or more bent away from the plane of the body portion. In a preferred embodiment, the tip of the central prong is bent away from one side of the body plane while the two outer prongs remain in the body plane. In the preferred embodiment, the body portion of the spring has an aperture and the spring is mounted and retained on the pivot by passing the pivot through the aperture.

In accordance with another important aspect of the invention, a means is provided for limiting clockwise and counterclockwise rotation of the truck assembly and the spring about the pivot. In a preferred embodiment, this means includes both clockwise and counterclockwise limit walls on the undersurface of the platform against which the truck assembly and spring eventually abut when rotated about the pivot.

MODES FOR CARRYING OUT THE INVENTION

Figure 1:
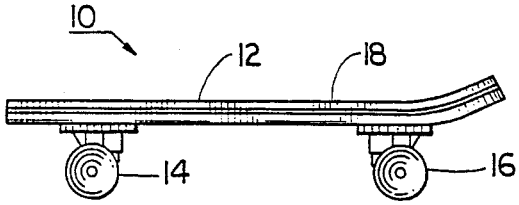
FIG. 1 is side elevational view of a skateboard with steerable truck assemblies in accordance with the present invention.

Referring initially to FIG. 1, there is illustrated a side elevational view of a toy skateboard with steerable truck assemblies, generally designated 10 of the present invention. The skateboard 10 is comprised of three primary assemblies: the platform 12, and two truck assemblies 14 and 15. The truck assemblies are identical to each other, but are mounted on the platform in opposite directions in order to cause the truck assemblies to pivot in opposite directions when the platform is tilted. On a full sized skateboard, the rider places his feet on the upper surface of the platform and turns the board by tilting the platform in the desired direction. The present toy skateboard 10 can be turned in a similar manner by placing one or two fingers on the upper surface 18 and tilting the platform 12 in the desired direction. This forces the truck assemblies 14 and 16 to turn causing the skateboard to move in the desired direction when it is pushed forward.

Figure 2:
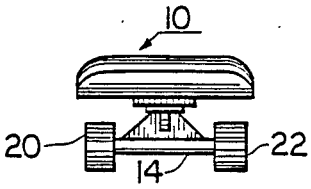
FIG. 2 is a front elevational view.
Figure 3:
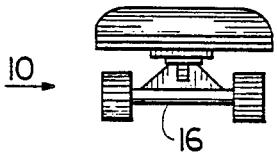
FIG. 3 is a rear elevational view.

FIG. 2 is a front elevational view of the toy skateboard 10 showing the front truck assembly with two wheels 20 and 22 mounted on either end of an axle which is not shown. FIG. 3 is a rear elevational view similar to FIG. 2 except that rear truck assembly 16 is shown.

Figure 4:
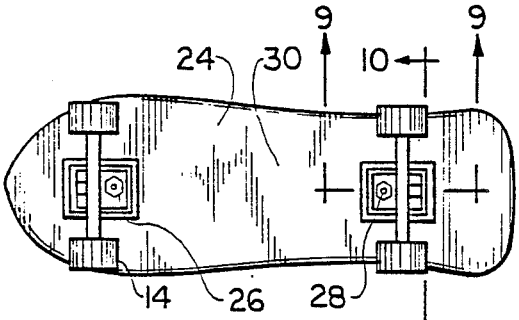
FIG. 4 is a bottom plan view.

FIG. 4 is a bottom plan view of the toy skateboard 10. The truck assemblies 14 and 16 are identical to each other as noted above but are mounted on the undersurface 24 opposite each other with their pivot ends 26 and 28 facing toward the center 30 of the skateboard 10. This arrangement is similar to that of a full sized skateboard which also has identical truck assemblies mounted with the pivots toward the center.

Figure 5:
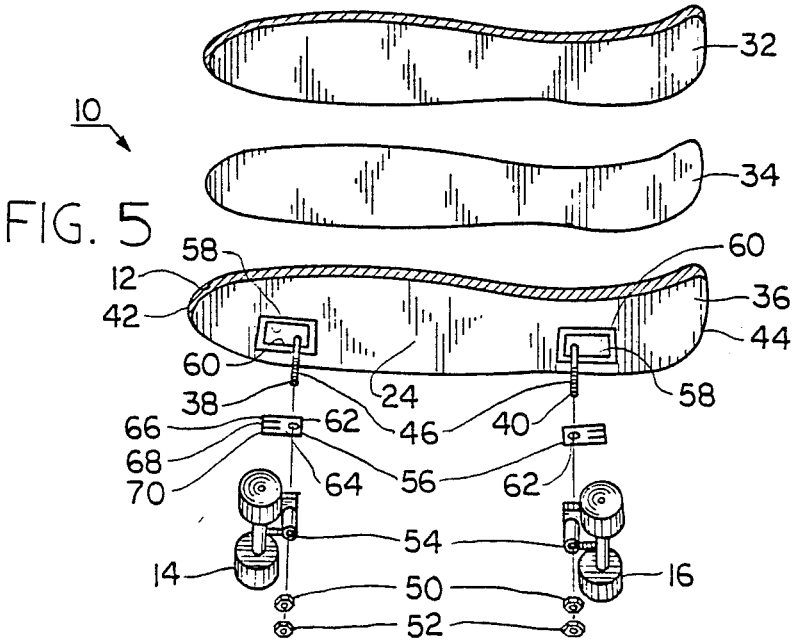
FIG. 5 is an exploded bottom perspective view.

FIG. 5 is an exploded view from the bottom showing the overall arrangement of the various components of the skateboard 10. In the preferred embodiment, the platform 12 is laminated of three pieces including a top plate 32 manufactured of clear plastic, a center 34 of paper which allows the appearance of the skateboard to be changed at low cost simply by printing different designs and words on the paper, and a bottom plate 36 also fabricated of clear plastic. The top and bottom plates 32 and 36 are fabricated separately of injection molded plastic and are then welded together ultrasonically along the edges around the paper.

Two mounting means 38 and 40 are provided on the undersurface 24 for mounting the truck assemblies 14 and 16. The mounting means are spaced from each other longitudinally along the platform 12 with one positioned near the front 42 and the other near the rear 44. Each mounting means has a pivot 46 projecting from the undersurface 24. In the preferred embodiment the pivots 46 are small screws. The mounting means 38 and 40 include pivot stops in the form of nuts 50 and 52 for retaining the truck assemblies 14 and 16 axially on the pivots 46. Double nuts are provided on each pivot in order to allow the fixed distance between the undersurface 24 and the nuts 50 to be maintained or adjusted as desired by loosening the nuts and then jamming them against nuts 52. Each pivot 46 passes through a mounting aperture 54 of its truck assembly to radially retain the assembly on the pivot.

As shown in FIG. 5, the pivots 46 project substantially perpendicular from the undersurface 24 of the platform 12. In order for the truck assemblies 14 and 16 to turn when the platform is tilted, the truck assemblies must tilt with respect to the platform. A tilting means is provided primarily by making the diameter of the apertures in the truck assemblies larger than the diameter of the pivots. Also the heads of the pivots are able to tilt slightly in the platform 12 as shown below in conjunction with FIG. 9.

Leaf springs 56 bias each of the truck assemblies 14 and 16 away from the underside 24. The springs 56 continuously push the trucks 14 and 16 against the nuts 50 forcing the opposite ends of the apertures 54 to touch the sides of the pivots as shown below in FIG. 9. When pressure is applied to one side of the platform 12, the sides of the springs on the same side yield to the pressure allowing the truck assemblies 14 and 16 to tilt.

Means are also provided on the undersurface for limiting the rotation of the trucks 14 and 16 about the pivots 46. In a full sized skateboard, two separate projections are provided for each truck assembly which together limit rotation. The present invention has only one member retaining each truck assembly 14 and 16, i.e. the pivots 46. Without a means for limiting rotation of the trucks about the pivots, the trucks could turn to extreme angles. Clockwise limit walls 58 and counterclockwise limit walls 60 are therefore provided for stopping the clockwise and counterclockwise rotation, respectively, within limits designed to simulate turns of full sized skateboards. These limit walls are unitarily molded with the bottom plate 36. These limit walls 58 and 60 also retain the springs 56 in the proper position. The springs are retained on the pivots 46 by passing the pivots through apertures 62 in the springs. Since the springs are mounted between the truck assemblies 14 and 16 and the undersurface 24, they are always inside the limit walls 58 and 60.

Figure 6:
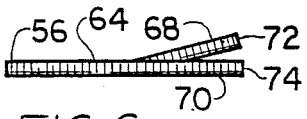
FIG. 6 is an enlarged side elevational view of the leaf spring.
Figure 7:
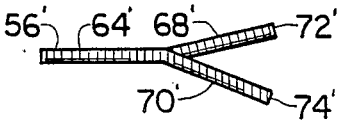
FIG. 7 is a view of another embodiment of the spring similar to FIG. 6.
Figure 8:
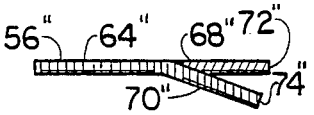
FIG. 8 is a view of yet another embodiment of the spring similar to FIG. 6.

FIGS. 6, 7, and 8 are enlarged side elevational views of various embodiments of the leaf springs 56. The leaf springs are preferably fabricated of thin spring metal. As shown in FIG. 5, each have a body portion 64 and three prongs 66, 68, and 70 projecting from the body portion substantially parallel to each other. In order to provide the necessary biasing of the trucks away from the undersurface, one or more of the prongs are bent away from the plane of the body portion 64 when the springs are not under load. Outer prongs 66 and 70 are always positioned in the same direction in order to provide balanced bias against the position of the central prong 68. Only the near outer prong 70 is shown in the FIG. 6, 7, and 8 because these figures are side elevational view. In all cases the other outer prong 66 is directly behind the near outer prong 70 and is in the same position. FIG. 6 shows the preferred embodiment with the tip 72 of the central prong 68 spaced from the plane of the body on a first side and the tips 74 of the outer two prongs 70 (and 66; remaining in the plane of the body. FIG. 7 shows another embodiment with the tip 72' of the central prong 68' again spaced from the plane of the body on the first side but now the tips 74' of the outer two prongs 70' (and 66') are spaced from the plane of the body on the second side opposite the first side. FIG. 8 shows a third embodiment with the tip 72" of the central prong 68" remaining in the plane of the body and the rips 74" of the outer two prongs 66"

and 70" spaced from the plane of the body on the second side.

Figure 9:
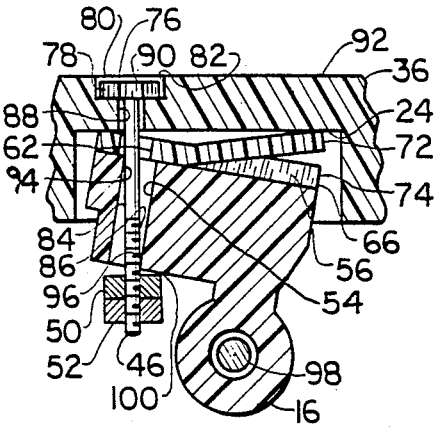
FIG. 9 is a partial enlarged sectional view along the line 9—9 of FIG. 3 without the top plate, center, or wheels.

FIG. 9 is a partial enlarged sectional view along the line 9—9 of FIG. 3 without the top plate, center, or wheels. The spring 56 of FIG. 6 is positioned on the pivot 46 between the undersurface 24 and the truck assembly 16. (It is noted that FIG. 9 is a sectional view through the middle of the spring 56 which is the reason for the different appearance. Of the outer prongs, only prong 66 is shown.) The pivot 46 passes through the aperture 54 in the truck assembly and the aperture 62 in the spring retaining both radially on the pivot. The nut 50 provides a pivot stop retaining both the truck and spring axially on the pivot. The head 76 of the pivot is preferably formed with sides 78 in the form of a hex and sits in a well 80 inside the bottom plate 36 which also has sides 82 formed into a hex. The complementary hex sides keep the pivot from rotating when the nuts 50 and 52 are rotated. Sufficient space is allowed between the sides 78 and 82, the sides 84 and 86 of the pivot and the aperture 88 through the undersurface 24, and the top 90 of the pivot and the top 92 of the bottom plate to allow the pivot to tilt with respect to the bottom plate. As shown in FIG. 9, the pivot 46 is substantially perpendicular to the bottom plate 36. However, the pivot can tilt until interference between the pivot and the bottom plate occurs. Similarly, the truck assembly 16 tilts about the pivot until the top and bottom walls 94 and 96 of the aperture 54 abut the sides 84 and 86, respectively, of the pivot. As weight is placed on the bottom plate 36, the weight is transferred through the axle 98 to the wheels which are not shown until the resistance of the spring 56 is overcome causing the tips 72 and 74 of the spring to approach each other. At the same time, the bottom 100 of the truck assembly lifts off the nut 50 which allows the truck to tilt from side to side in relation to the bottom plate 36.

Figure 10:
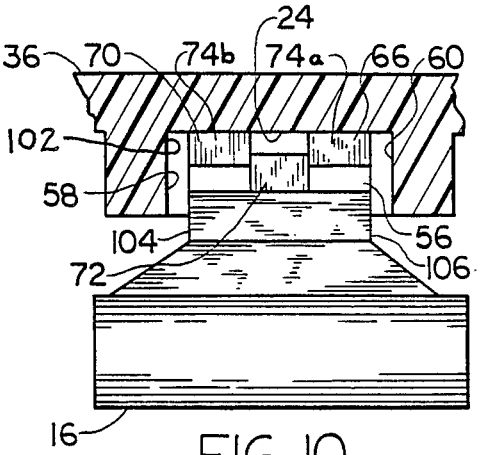
FIG. 10 is a partial enlarged sectional view along the line 10—10 of FIG. 3 without the top plate, center, or wheels.

FIG. 10 is a partial enlarged sectional view along the line 10—10 of FIG. 3 again without the top plate, center, or wheels showing a view of the truck assembly 16 of FIG. 9 from the right side on the same scale. As in FIG. 9, the truck is shown with no weight on the bottom plate 36. The tips 74*a* and 74*b* of the two outer prongs 66 and 70 provide equal pressure against the undersurface 24 to hold the bottom plate in a substantially horizontal position and the truck assembly 16 in a substantially straight forward position. The effect of the spring 56 is the same as that of the rubber washers in a full sized skateboard which return the truck to the straight forward position when no tilting pressure is applied to one of the sides. The truck assembly 16 sits in a well 102 on the undersurface 24 formed by the clockwise and clockwise limit walls 58 and 60. Turning of the truck assembly is stopped when the sides 104 or 106 of the truck assembly touch one or both of the limit walls.

Figure 11:
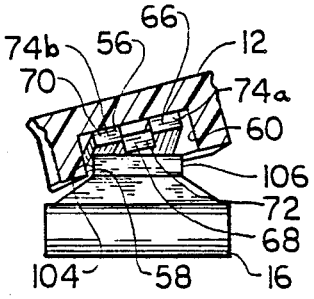
FIG. 11 is sectional view similar to FIG. 10 reduced to half size with the platform tilted to the left.

FIG. 11 is sectional view similar to FIG. 10 reduced to half size with the platform 12 tilted to the left. The platform is also rotated to the left while the truck assembly 16 remains stationary in order to retain the clarity of the illustration. In actuality the truck turns in relation to the platform. FIG. 11 represents the turning which occurs when the platform is tilted to the left side. The turning of the truck assembly is stopped by the abutment of one or both of the sides 104 and 106 of the truck against the limit walls 58 and 60. The spring 56 is distorted with the tip 74*b* of the outer prong 70 approaching the tip 72 of the central prong 68 due to the weight applied to the left side and the tip 74*a* moving away from the tip 72 of the outer prong 66.

Figure 12:
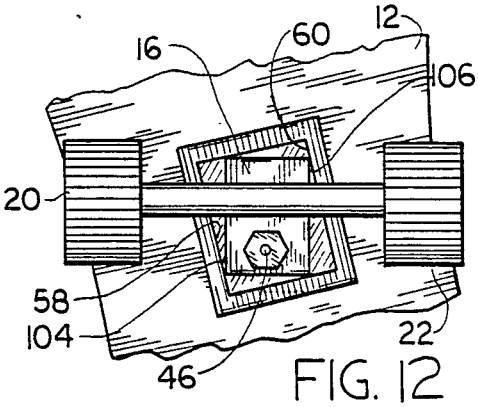
FIG. 12 is a partial bottom plan view of the rear truck turned at the angle shown in FIG. 11 and in the same scale as FIG. 11.

FIG. 12 is a partial bottom plan view of the rear truck assembly 16 turned at the angle shown in FIG. 11 and in the same scale as FIG. 11. The wheels 20 and 22 nave been added and a greater portion of the platform 12 is shown. The turning of the truck assembly 16 about the pivot 46 when pressure is applied to the left side is limited by the abutment of one or both of the sides 104 and 106 against the limit walls 58 and 60.

The exact reason the truck assembly turns with respect to the platform is not entirely understood although it would appear to be due to the angular relationships between the platform, pivot, and truck assembly. As shown in FIG. 11, when the platform is tilted to the left the tip 74*a* becomes relatively unweighted in relation to the tip 74*b*. The movement of the tip 74*b* away from the plane of the body of the spring moves the platform counterclockwise with respect to the truck assembly when viewed from the top.

Figure 13:
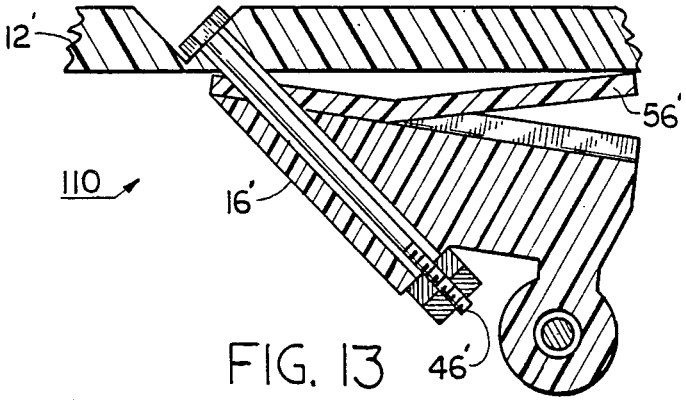
FIG. 13 is an enlarged sectional view similar to FIG. 9 of another embodiment.

FIG. 13 is an enlarged sectional view similar to FIG. 9 of another embodiment, generally designated 110, where the pivot 46' is installed at an angle of 45° with respect to the platform 12' and the truck assembly 16'. The spring 56' and other features remain substantially the same as in the prior embodiment. This angular relationship more nearly approaches that found on a full sized skateboard. When pressure is applied to one side of the platform, the truck assembly 16' turns in the same manner as the truck assembly 16 in the previous embodiment.

In view of the above, it may be seen that a toy skateboard with steerable truck assemblies is provided. Of course, the structure may be variously implemented depending upon specific applications. Accordingly, the scope hereof shall not be referenced to the disclosed embodiments, but on the contrary, shall be determined in accordance with the claims as set forth below.

I claim:

1. A toy skateboard comprising:

a platform having an undersurface;

two truck assemblies, each having a mounting aperture;

two longitudinally spaced mounting means for retaining said two truck assemblies on said platform adjacent said undersurface, one of said mounting means holding one of said truck assemblies and the other of said mounting means holding the other of said truck assemblies, each mounting means having:

a pivot projecting from said undersurface;

said pivot passing through said mounting aperture of said truck assembly radially retaining said truck assembly on said pivot; and means for retaining said truck assembly axially on said pivot;

means for allowing each of said truck assemblies to be tilted in relation to its pivot;

a clockwise limit wall on said undersurface for each of said truck assemblies against which said truck assembly abuts when rotated in a clockwise direction about said pivot;

a counterclockwise limit wall on said undersurface for each of said truck assemblies against which said truck assembly abuts when rotated in a counterclockwise direction about said pivot; and means for biasing each of said truck assemblies away from said undersurface including a leaf spring positioned between said truck assembly and said undersurface, said leaf spring including:

a body portion having a body plane;

three prongs projecting from said body portion substantially parallel to each other, each prong having a tip; and said three prongs spaced when not under load in at least one of said following arrays:

said tip of the central of said three prongs spaced from said body plane on a first side of said body plane and said tips of the outer two prongs spaced from said body plane on a second side of said body plane opposite said first side;

said tip of said central of said three prongs positioned in said body plane and said tips of said outer two prongs spaced from said body plane on the same side of said body plane; and said tip of said central prong spaced from said body plane and said tips of said outer two prongs positioned in said body plane.

2. A toy skateboard according to claim 1 wherein:

said leaf spring further includes said body portion having a spring aperture and said pivot passes through said spring aperture retaining said leaf spring radially on said pivot;

said clockwise limiting means further limits clockwise rotation of said leaf spring about said pivot; and said counterclockwise limiting means further limits counterclockwise rotation of said leaf spring about said pivot.

3. A toy skateboard comprising:

a platform having an undersurface;

two truck assemblies, each having a mounting aperture;

two longitudinally spaced mounting means for retaining said two truck assemblies on said platform adjacent said undersurface, one of said mounting means holding one of said truck assemblies and the other of said mounting means holding the other of said truck assemblies, each mounting means having:

a pivot projecting from said undersurface;

said pivot passing through said mounting aperture of said truck assembly radially retaining said truck assembly on said pivot; and means for retaining said truck assembly axially on said pivot;

means for allowing each of said truck assemblies to be tilted in relation to its pivot; and means for biasing each of said truck assemblies away from said undersurface including a leaf spring positioned between said truck assembly and said undersurface, said leaf spring including:

a body portion having a body plane;

three prongs projecting from said body portion substantially parallel to each other, each prong having a tip; and said three prongs spaced when not under load in at least one of said following arrays:

said tip of the central of said three prongs spaced from said body plane on a first side of said body plane and said tips of the outer two prongs spaced from said body plane on a second side of said body plane opposite said first side;

said tip of said central of said three prongs positioned in said body plane and said tips of said outer two prongs spaced from said body plane on the same side of said body plane; and said tip of said central prong spaced from said body plane and said tips of said outer two prongs positioned in said body plane.

4. A toy skateboard according to claim 3 wherein:

said leaf spring further includes said body portion having a spring aperture and said pivot passes through said spring aperture retaining said leaf spring radially on said pivot, and further including:

means for limiting clockwise rotation of said truck assembly and said leaf spring about said pivot; and means for limiting counterclockwise rotation of said truck assembly and said leaf spring about said pivot.

5. A toy skateboard according to claim 4 wherein:

said clockwise limiting means includes a clockwise limit wall on said undersurface against which said truck assembly and said leaf spring abut when rotated in a clockwise direction about said pivot; and said counterclockwise limiting means includes a counterclockwise limit wall on said undersurface against which said truck assembly and said leaf spring abut when rotated in a counterclockwise direction about said pivot.

* * * * *